US009359863B2

(12) United States Patent
Streich et al.

(10) Patent No.: US 9,359,863 B2
(45) Date of Patent: Jun. 7, 2016

(54) DOWNHOLE PLUG APPARATUS

(71) Applicant: HALLIBURTON ENERGY SERVICES, INC., Carrollton, TX (US)

(72) Inventors: Steven G. Streich, Duncan, OK (US); Donnie G. Loveday, Duncan, OK (US); Donny W. Winslow, Duncan, OK (US); John T. Brandell, Duncan, OK (US); Earl D. Webb, Wilson, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 469 days.

(21) Appl. No.: 13/868,735

(22) Filed: Apr. 23, 2013

(65) Prior Publication Data

US 2014/0311752 A1 Oct. 23, 2014

(51) Int. Cl.
*E21B 33/128* (2006.01)
*E21B 33/134* (2006.01)
*E21B 33/12* (2006.01)

(52) U.S. Cl.
CPC ..... *E21B 33/134* (2013.01); *E21B 33/1204* (2013.01)

(58) Field of Classification Search
CPC .... E21B 33/1204; E21B 33/128; E21B 29/00
USPC ..... 166/376, 202
See application file for complete search history.

(56) References Cited

U.S. PATENT DOCUMENTS 3,283,821 A * 11/1966 Brown ..... E21B 33/1208 166/134
3,306,362 A * 2/1967 Urbanosky ..... E21B 33/1204 166/123
4,311,196 A 1/1982 Beall et al.
5,224,540 A 7/1993 Streich
5,271,468 A 12/1993 Streich
5,479,986 A 1/1996 Gano
5,607,017 A 3/1997 Owens
6,220,350 B1 4/2001 Brothers
6,397,950 B1 * 6/2002 Streich ..... E21B 17/00 166/177.2
6,472,068 B1 10/2002 Glass
7,168,494 B2 1/2007 Starr
8,528,633 B2 9/2013 Agrawal et al.
2003/0168214 A1 * 9/2003 Sollesnes ..... E21B 29/00 166/250.08
2006/0021748 A1 * 2/2006 Swor ..... E21B 29/02 166/55
2011/0132620 A1 6/2011 Agrawal et al.
2011/0315398 A1 12/2011 Ueland
2012/0160521 A1 6/2012 McGlothen et al.
2013/0284425 A1 10/2013 Agrawal et al.

OTHER PUBLICATIONS

International Search Report and Written Opinion of the International Searching Authority dated Jun. 3, 2014, filed in corresponding PCT Application Serial No. PCT/US2014/017984.

* cited by examiner

*Primary Examiner* — Jennifer H Gay
*Assistant Examiner* — George Gray
(74) *Attorney, Agent, or Firm* — McAfee & Taft, P.C.

(57) ABSTRACT

The present invention relates to downhole tools and methods of removing such tools from wellbores. More particularly, the present invention relates to downhole tools designed to be comprised of dissolvable materials or frangible materials and methods for dissolving or fragmenting such downhole tools in situ.

12 Claims, 9 Drawing Sheets

DOWNHOLE PLUG APPARATUS

FIELD OF THE INVENTION

The present invention relates to downhole tools and methods of removing such tools from wellbores. More particularly, the present invention relates to downhole tools designed to be comprised of dissolvable materials or frangible materials and methods for dissolving or fragmenting such downhole tools in situ.

BACKGROUND OF THE INVENTION

A wide variety of downhole tools may be used within a wellbore in connection with producing hydrocarbons or reworking a well that extends into a hydrocarbon formation. Downhole tools such as frac plugs, bridge plugs, and packers, for example, may be used to seal a component against casing along the wellbore wall or to isolate one pressure zone of the formation from another. Such downhole tools are well known in the art.

After the production or reworking operation is complete, these downhole tools must be removed from the wellbore. Tool removal has conventionally been accomplished by complex retrieval operations, or by milling or drilling the tool out of the wellbore mechanically. Thus, downhole tools are either retrievable or disposable. Disposable downhole tools have traditionally been formed of drillable metal materials such as cast iron, brass and aluminum. To reduce the milling or drilling time, the next generation of downhole tools was formed from composites and other non-metallic materials, such as engineering grade plastics. Nevertheless, milling and drilling continues to be a time consuming and expensive operation. Therefore, a need exists for disposable downhole tools that are removable without being milled or drilled out of the wellbore, and for methods of removing disposable downhole tools without tripping a significant quantity of equipment into the wellbore.

SUMMARY OF THE INVENTION

In accordance with one embodiment of the invention there is provided a downhole apparatus for use in a wellbore. The apparatus comprises a center mandrel, a slip assembly, a cup shaped sealing element, a ring element and a sleeve. The slip assembly is disposed on the mandrel. The slip assembly grippingly engages the wellbore when the downhole apparatus is in a set position. The cup shaped sealing element is disposed on the mandrel. The sealing element sealingly engages the wellbore when the downhole apparatus is in the set position. The ring element is disposed on the mandrel and operationally engages the sealing element and the slip assembly such that, when a setting force is applied to the ring element, the ring element outwardly expands thus transferring the setting force to the sealing element such that the sealing element sealingly engages the wellbore and the ring element axially transfers the setting force to the slip assembly such that the slip assembly grippingly engages the wellbore. The sleeve is disposed on the mandrel. The sleeve transfers the setting force from a setting tool to the ring element when the downhole apparatus is changed from an unset position to the set position.

In accordance with another embodiment of the invention there is provided a downhole apparatus for use in a wellbore. The apparatus comprises a central mandrel, and a sealing element. The central mandrel is comprised of frangible material that breaks apart under impact or pressure wave. The sealing element is disposed about the mandrel wherein the sealing element sealingly engages the wellbore when the downhole apparatus is in a set position.

In accordance with yet another embodiment of the invention there is provided a method of performing a downhole operation wherein a downhole tool is disposed within a wellbore. The method comprises:

lowering a fragmenter downhole; and fragmenting a first portion of the downhole tool using the fragmenter wherein the first portion of the downhole tool is composed of frangible material.

DESCRIPTION OF EXEMPLARY EMBODIMENTS

Figure 1:
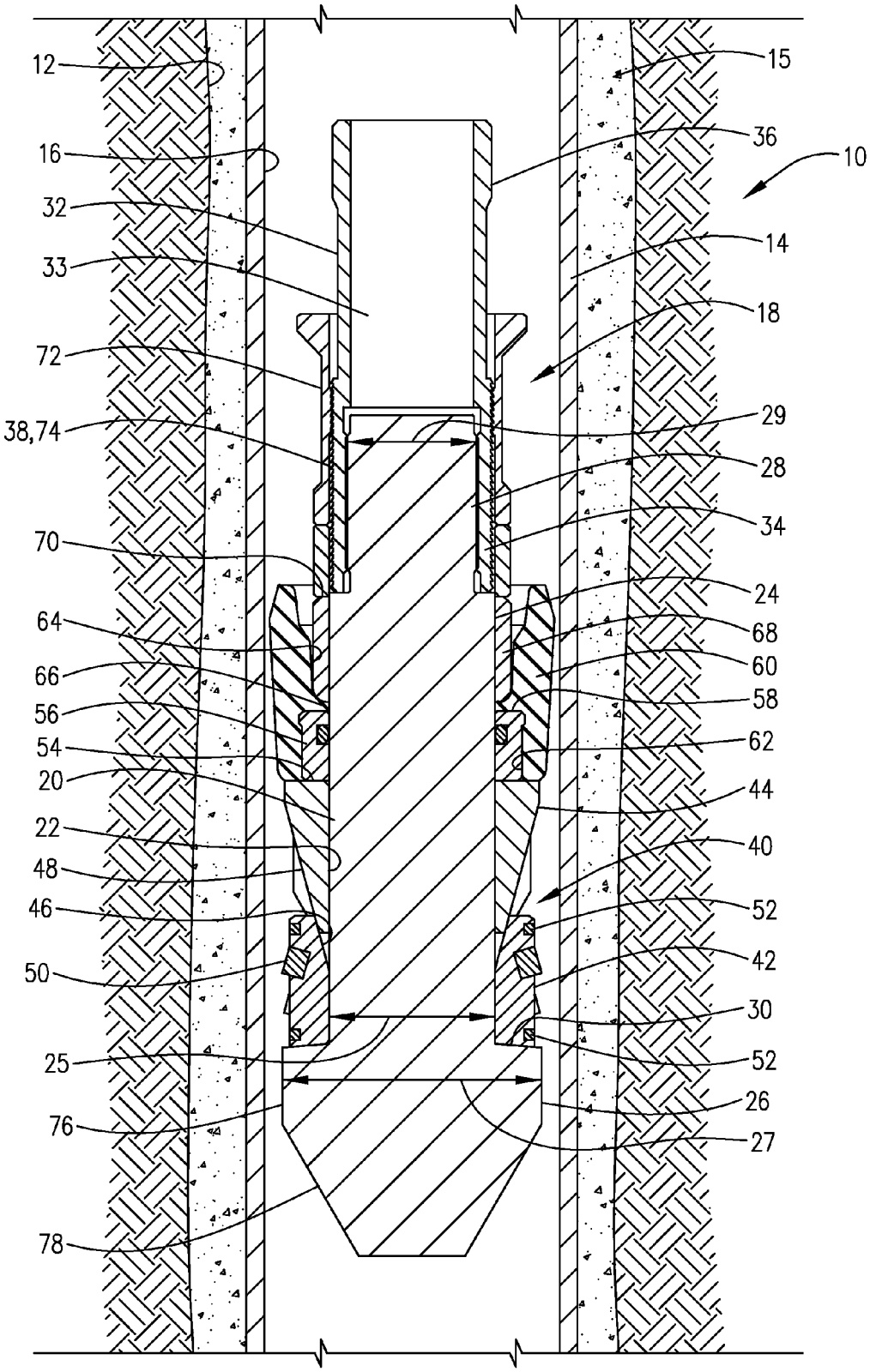
FIG. 1 is a schematic, cross-sectional view of a wellbore in which a downhole tool in accordance with one embodiment of the invention is illustrated. The downhole tool is illustrated in the unset position.
Figure 2:
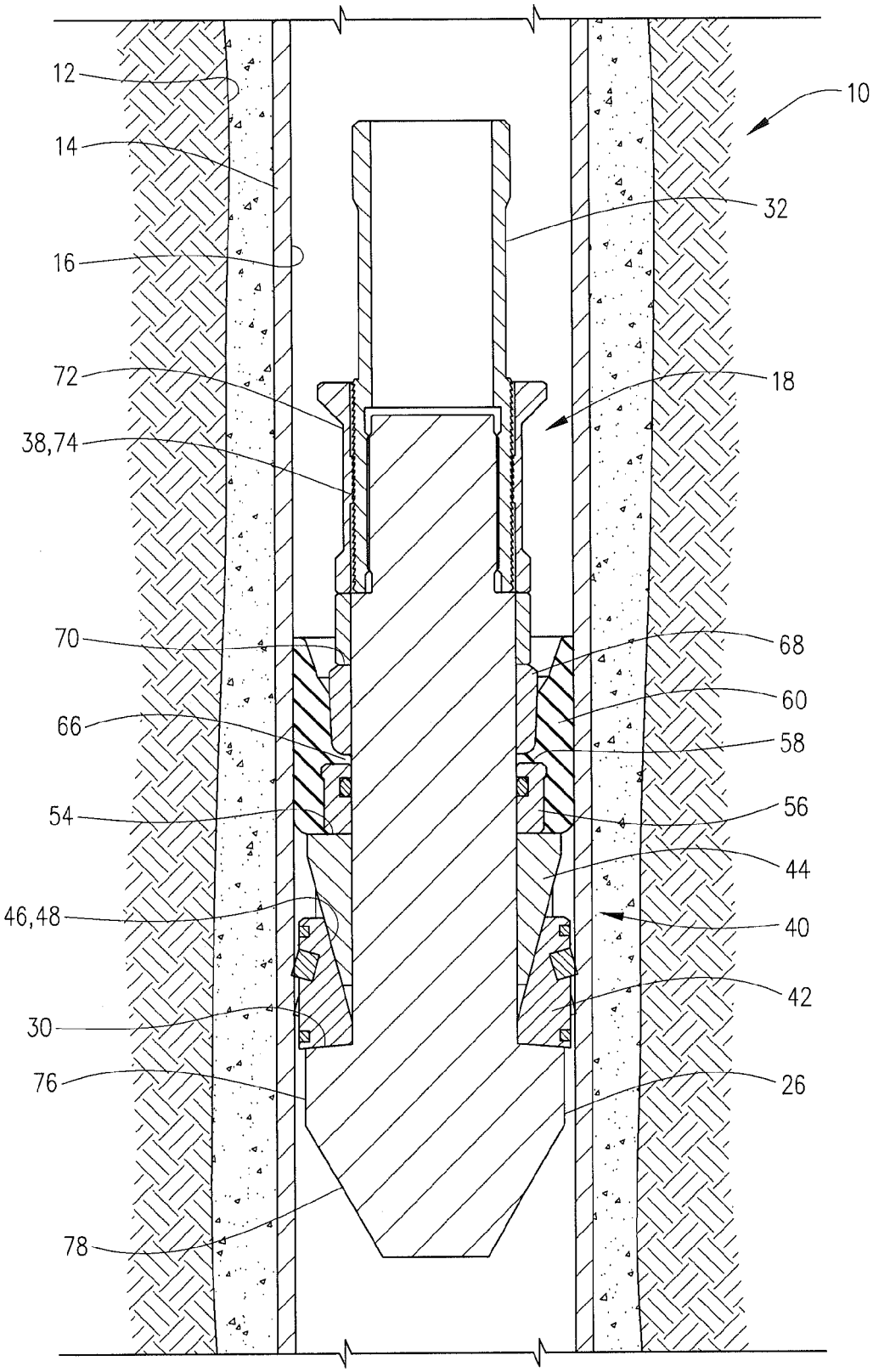
FIG. 2 is a schematic, cross-sectional view of a wellbore in which a downhole tool in accordance with the embodiment of FIG. 1 is illustrated. The downhole tool is illustrated in the set position.

Referring to the drawings, FIGS. 1 and 2 illustrate well 10 having wellbore 12 with casing 14 cemented therein by cement 15. Casing 14 has inner wall 16. The invention as described herein is applicable to wellbores with and without casing and, as used herein, the term wellbore will include wellbores having casing cemented therein. Additionally, in the below description, the terms lower, upper, top, bottom and similar are used to describe the elements of a downhole tool; however, it should be understood that such terms are used to indicate the relative position of the elements to one another and that the actual orientation in the well may be different from the description; for example, the downhole tool could be positioned sideways in a laterally extending wellbore.

Within wellbore 12 is downhole tool 18. In the embodiment of the invention illustrated in FIGS. 1-3, downhole tool 18 is referred to as a frac plug; however, embodiments of the invention are useful in other downhole tools such as bridge plugs and packers. Downhole tool 18 is a low pressure downhole tool in that it is designed to use a lower setting pressure than traditional downhole tools making it more suitable for use with frangible materials.

Figure 3:
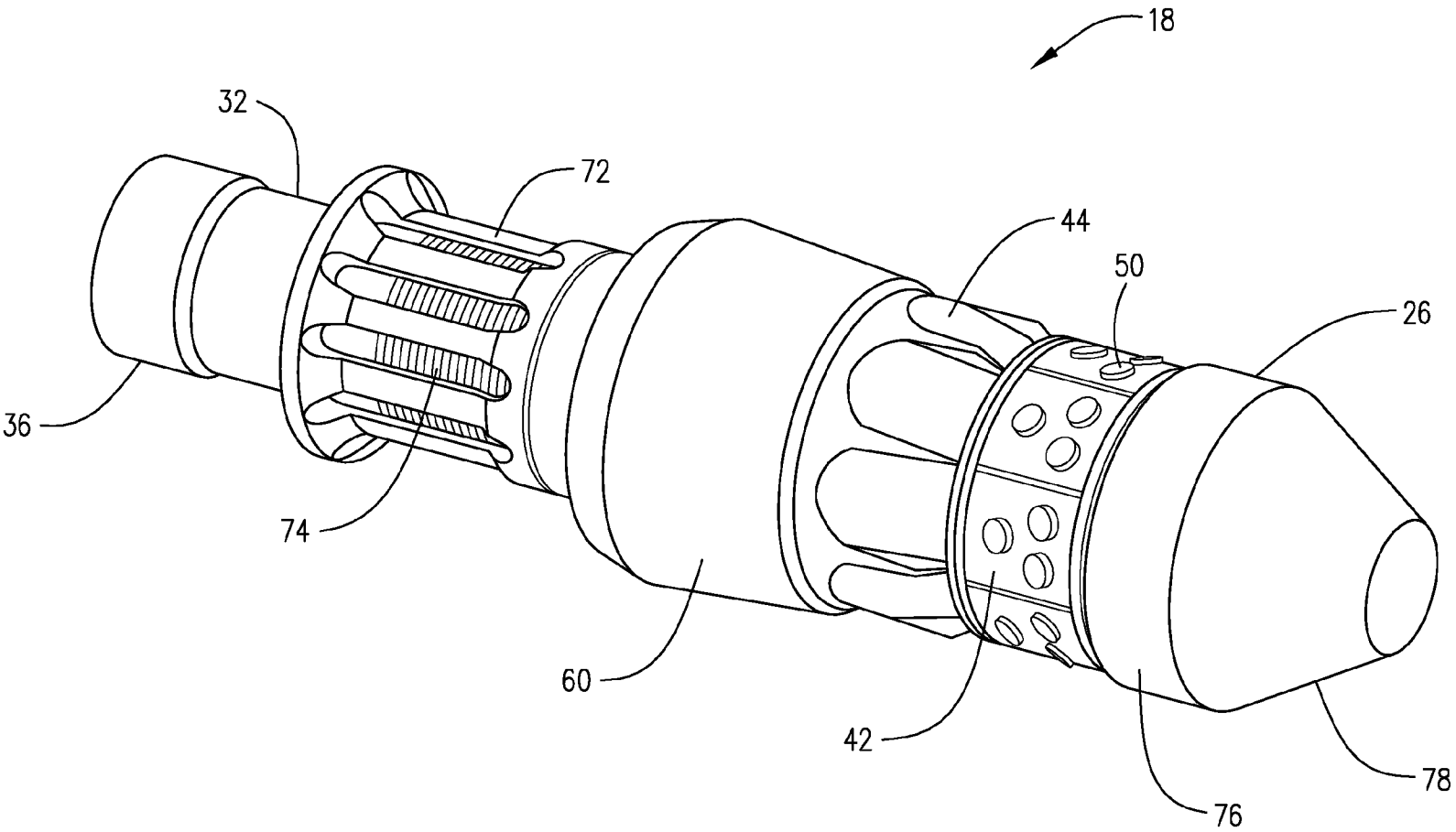
FIG. 3 is a perspective view of the downhole tool of the embodiment of FIGS. 1 and 2.

In FIG. 1, downhole tool 18 is shown in its unset configuration or unset position. In FIG. 2, downhole tool 18 is shown in its set configuration or set position. FIG. 3 illustrates a perspective view of downhole tool 18 in its unset position. As illustrated in FIGS. 1-3, downhole tool 18 includes central mandrel 20 with an outer surface 22. Mandrel 20 has an axially extending central portion 24, which terminates at first or lower end in end portion or shoe 26 and at a second or upper end in top portion 28. Shoe 26 has a cylindrical portion 76 and a truncated conical portion 78. It will be noted that, cylindrical portion 76 of shoe 26 has a diameter 27, which is greater than the diameter 25 of central portion 24, thus, creating an upward facing shoulder 30. It will also be noted that the diameter 29 of top portion 28 is less than the diameter 25 of central portion 24. Top portion 28 is configured to be connected to a setting tool connector 32. Setting tool connector 32 has a lower end 34 configured to be connected to top portion 28 of mandrel 20 and an upper end 36 configured to be connected to a setting tool. Lower end portion 34 of setting tool connector 32 has ratcheting teeth 38 on its exterior.

A slip assembly 40 is positioned on and/or disposed about mandrel 20. Upward facing shoulder 30 provides an abutment, which serves to axially retain slip assembly 40 from downward movement. When downhole tool 18 is in its set position, slip assembly 40 provides anchoring for downhole tool 18 by grippingly engaging wellbore 12, which is by grippingly engaging casing 14 if it is present. Slip assembly 40 includes a slip ring 42 and a slip wedge 44. Slip ring 42 has an inclined/wedge-shaped first surface 46 positioned proximate to an inclined/wedge-shaped complementary second surface 48 of slip wedge 44. Slip ring 42 can have wickers or buttons 50 positioned on its outer surface. Buttons 50 bite into wellbore 12 or casing 14 when downhole tool 18 is placed in its set position, thus anchoring downhole tool 18. Slip ring 42 can be an integral unit of frangiblely connected slip segments or can comprise slip segments held in place by retaining bands 52, as is known in the art.

At its upper end 54, slip wedge 44 abuts retaining ring 56 and cup-shaped sealing element 60. Sealing element 60 and retaining ring 56 are disposed about mandrel 20. Sealing element 60 is generally cup-shaped in that it forms a first chamber 62 and a second chamber 64 separated by radially extending portion 66. First chamber 62 houses retaining ring 56 and second chamber 64 houses ring element 68, which is disposed about mandrel 20. Accordingly, at upper end 58, retaining ring 56 abuts radially extending portion 66, which is sandwiched between retaining ring 56 and ring element 68. At its upper end 70, ring element 68 abuts ratcheted sleeve 72, which is disposed about mandrel 20. Ratcheted sleeve 72 has a generally axial-extending cylindrical shape with ratcheting teeth 74 on its inner surface that mate with ratcheting teeth 38 on setting tool connector 32.

Ring element 68 and sealing element 60 are generally comprised of material that can hold a pressure seal. For example, ring element 68 and sealing element 60 can be made from materials including, but not limited to, fluorocarbon elastomer or nitrile rubber. While the other portions of downhole tool 18 can be made from metal or composite material, in one embodiment of the inventions at least some of them will be made from material selected from the group comprising frangible materials or dissolvable materials and combinations thereof. In one embodiment of the invention at least mandrel 20 is made from a frangible material or a dissolvable material. Typically, at least mandrel 20 and slip wedge 44 will be made from frangible material or dissolvable material. Additionally, other components such as slip ring 42 can be made from frangible material or dissolvable material.

By frangible materials it is meant materials that can hold up to the downhole environment for the period of time the plug is needed in the wellbore but which can be readily broken up into fragments by impact or application of pressure waves and without resorting to drilling or other severe techniques. The components may be formed of any frangible material that is suitable for service in a downhole environment and that provides adequate strength to enable proper operation of downhole tool 18. Suitable frangible materials include materials made from glass or glass ceramics. Suitable glass materials can be selected from the group consisting of borosilicate, aluminosilicate, soda lime, sapphire, fused quartz/silica and combinations thereof. The frangible material can be chemically or thermally treated to increase its strength, as is known in the art. When frangible materials are used in the components of the downhole tool, it generally becomes necessary to use lower setting force than is used with traditional downhole tools. Downhole tool 18 described above advantageously utilizes such lower setting force and, thus, is well suited for the use of frangible materials. In downhole tool 18 the setting force is applied to the mandrel 20 and ratchet sleeve 72 and then directly transferred into the sealing element 60 and the slip assembly 40. The cup-shaped sealing element 60 serves to reduce the force required to set the downhole tool.

By dissolvable materials it is meant materials that dissolve when exposed to a chemical solution, an ultraviolet light, a nuclear source or a combination thereof. The components may be formed of any dissolvable material that is suitable for service in a downhole environment and that provides adequate strength to enable proper operation of downhole tool 18. By way of example only, one such material is an epoxy resin that dissolves when exposed to a caustic fluid. Another such material is a fiberglass that dissolves when exposed to an acid. Still another such material is a binding agent, such as an epoxy resin, for example, with glass reinforcement that dissolves when exposed to a chemical solution of caustic fluid or acidic fluid. Other such materials include various dissolvable metals. Any of these exemplary materials could also degrade when exposed to an ultraviolet light or a nuclear source. Thus, the materials may dissolve from exposure to a chemical solution, or from exposure to an ultraviolet light or a nuclear source, or by a combination thereof. The particular material matrix used to form the dissolvable components of the downhole tool 18 are customizable for operation in a particular pressure and temperature range, or to control the dissolution rate of the downhole tool 18 when exposed to a chemical solution, an ultraviolet light, a nuclear source, or a combination thereof. Thus, a dissolvable downhole tool 18 may operate as a 30-minute plug, a three-hour plug, or a three-day plug, for example, or any other timeframe desired by the operator. Alternatively, the chemical solution may be customized, and/or operating parameters of the ultraviolet light source or nuclear source may be altered, to control the dissolution rate of the plug comprising a certain material matrix.

Figure 4:
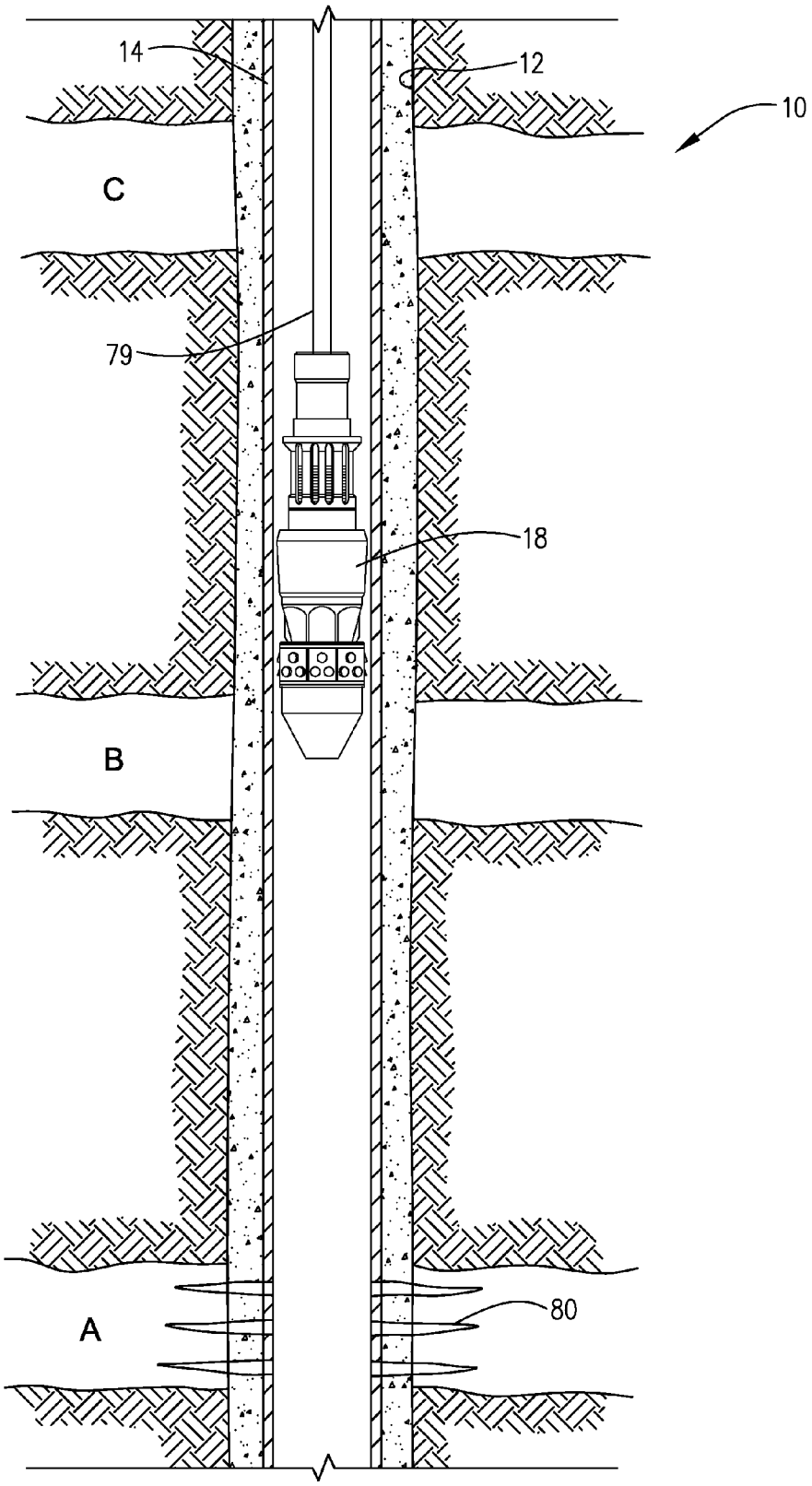
FIG. 4 is a schematic, cross-sectional view of a wellbore in which a downhole tool is shown in accordance with an embodiment of the invention is illustrated. The well is illustrated with producing zones A, B and C. The downhole tool is illustrated as being lowered into the well.
Figure 5:
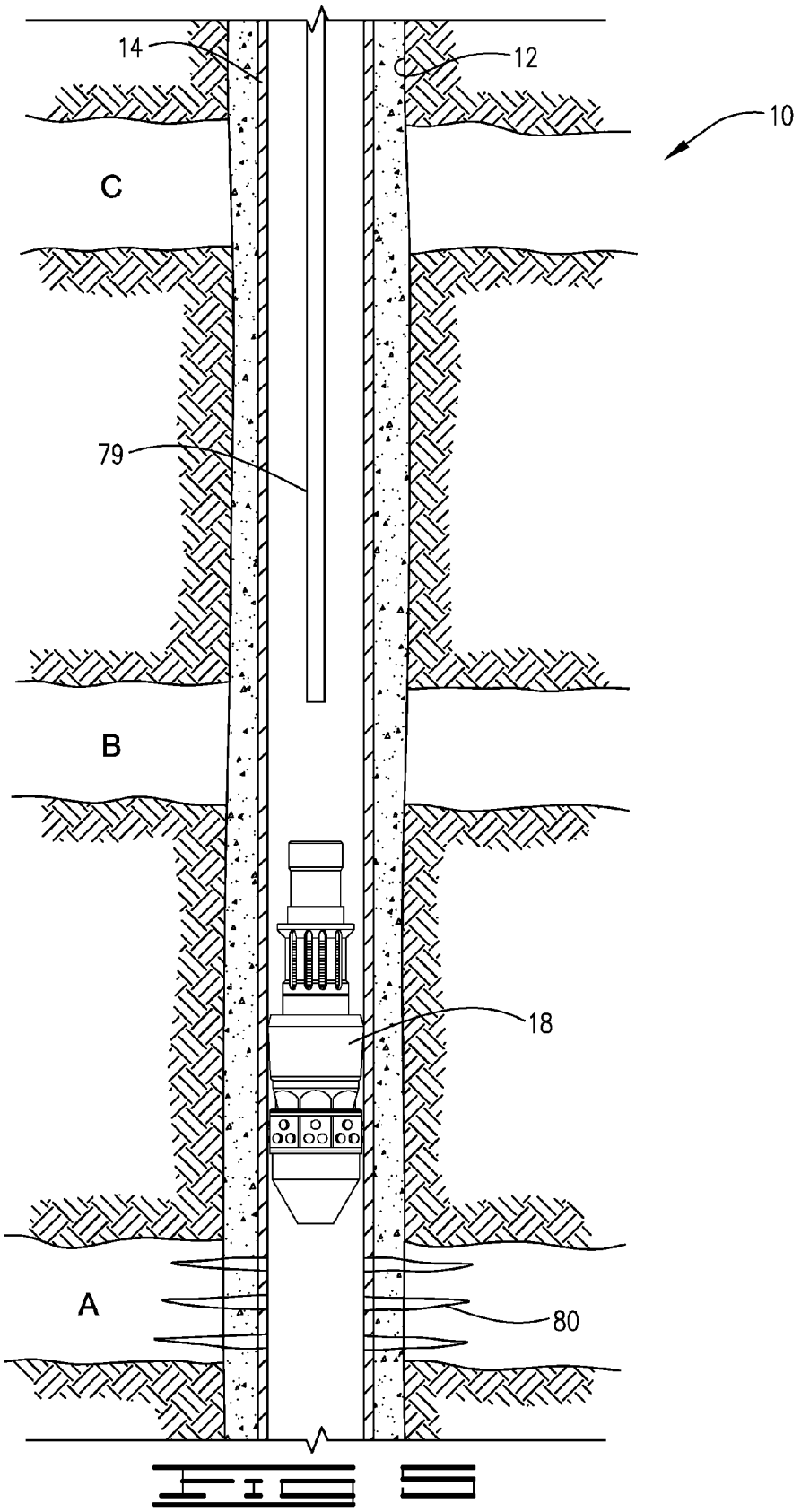
FIG. 5 is a schematic, cross-sectional view of a wellbore in which a downhole tool in accordance with the embodiment of FIG. 4 is illustrated. The downhole tool is illustrated as being set between producing zones A and B.

In operation, downhole tool 18 may be used in well operations such as stimulation/fracturing operations to isolate the zone of the formation below the downhole tool 18. Referring now to FIGS. 4 and 5, the downhole tool is shown being lowered into wellbore 12 (FIG. 4) and set between producing zone A and producing zone B (FIG. 5). In a conventional well stimulation/fracturing operation, before setting the downhole tool 18 to isolate zone A from zone B, a plurality of perforations 80 are made by a perforating tool (not shown) through the casing 14 cement 15 to extend into producing zone A. Then a well stimulation fluid is introduced into the wellbore 12, such as by lowering a tool (not shown) into the wellbore 12 for discharging the fluid at a relatively high pressure or by pumping the fluid directly from the drilling rig into the wellbore 12. The well stimulation fluid passes through the perforations 80 into producing zone A for stimulating the recovery of fluids in the form of oil and gas containing hydrocarbons. These production fluids pass from zone A, through the perforations 80, and up the wellbore 12 for recovery at the drilling rig.

Downhole tool 18 is then lowered by a cable 79 to the desired depth within the wellbore 12. Once in the desire location, downhole tool 18 is changed from its unset position to its set position by engaging a setting tool (not shown) with the setting tool connector 32 at upper end 36. The setting tool applies axial force to ratcheted sleeve 72 causing it to move axially toward ring element 68 from a first position to a second position and thereby asserting axial force on ring element 68. The interaction of ratcheting teeth 38 and 74 prevent sleeve 72 from moving axially away from ring element 68. Thus, even if the setting tool is disengaged, sleeve 72 will remain in the second position and maintain its pressure on ring element 68.

Ring element 68 transfers axial force to retaining ring 56 through radial extending portion 66. Retaining ring 56 moves axially and, in turn, transfers the axial force to slip wedge 44 of slip assembly 40. This causes slip wedge 44 to move axially with first surface 46 and second surface 48 sliding over one another so that slip wedge 44 moves further underneath slip ring 42; that is, between slip ring 42 and mandrel 20. The movement of slip wedge 44 exerts a radially outward force on slip ring 42 so that it grippingly engages the wellbore 12, generally the inner wall 16 of casing 14. As slip ring 12 grippingly engages wellbore 12, the axial force on ring element 68 causes compression; thus, ring element 68 not only transfers axial force to retaining ring 56 through radial extending portion 66, but also expands radially outwardly because of the compression. Thus, ring element 68 exerts an outward radial force on sealing element 60 causing it to sealingly engage the wellbore 12, generally the inner wall 16 of casing 14. Thus, the sealing element 60 is set against the wellbore 12 and the downhole tool 18 has been placed in its set position, thereby isolating zone A as depicted in FIG. 5.

After the downhole tool 18 is set into position as shown in FIG. 5, a second set of perforations 82 (FIGS. 6-8) may then be formed through the casing 14 and cement 15 adjacent intermediate producing zone B. Zone B is then treated with well stimulation fluid, causing the recovered fluids from zone B to pass through the perforations 82 into the wellbore 12.

After the fluid recovery operations are complete, the downhole tool 18 must be removed from the wellbore 12. In this context, as stated above, at least some of the components of downhole tool 18 are frangible, dissolvable or both. Generally, the components will be either frangible or dissolvable. This nature of the components eliminates the need to mill or drill downhole tool 18 out of the wellbore 12. Thus, when at least some of the components are frangible, they can be fragmented by use of a fragmenter, which fragments the components by impact, pressure wave or a combination thereof causing the downhole tool 18 to release from the wellbore 12 and the fragmented components, along with the unfragmented components, fall to the bottom of the wellbore 12. Similarly, where at least some of the components are dissolvable, they can be dissolved by exposing downhole tool 18 to a chemical solution, an ultraviolet light, a nuclear source, or a combination thereof, and at least some of its components will dissolve, causing the downhole tool 18 to release from the wellbore 12, and the undissolved components of downhole tool 18 to fall to the bottom of the wellbore 12.

Figure 6:
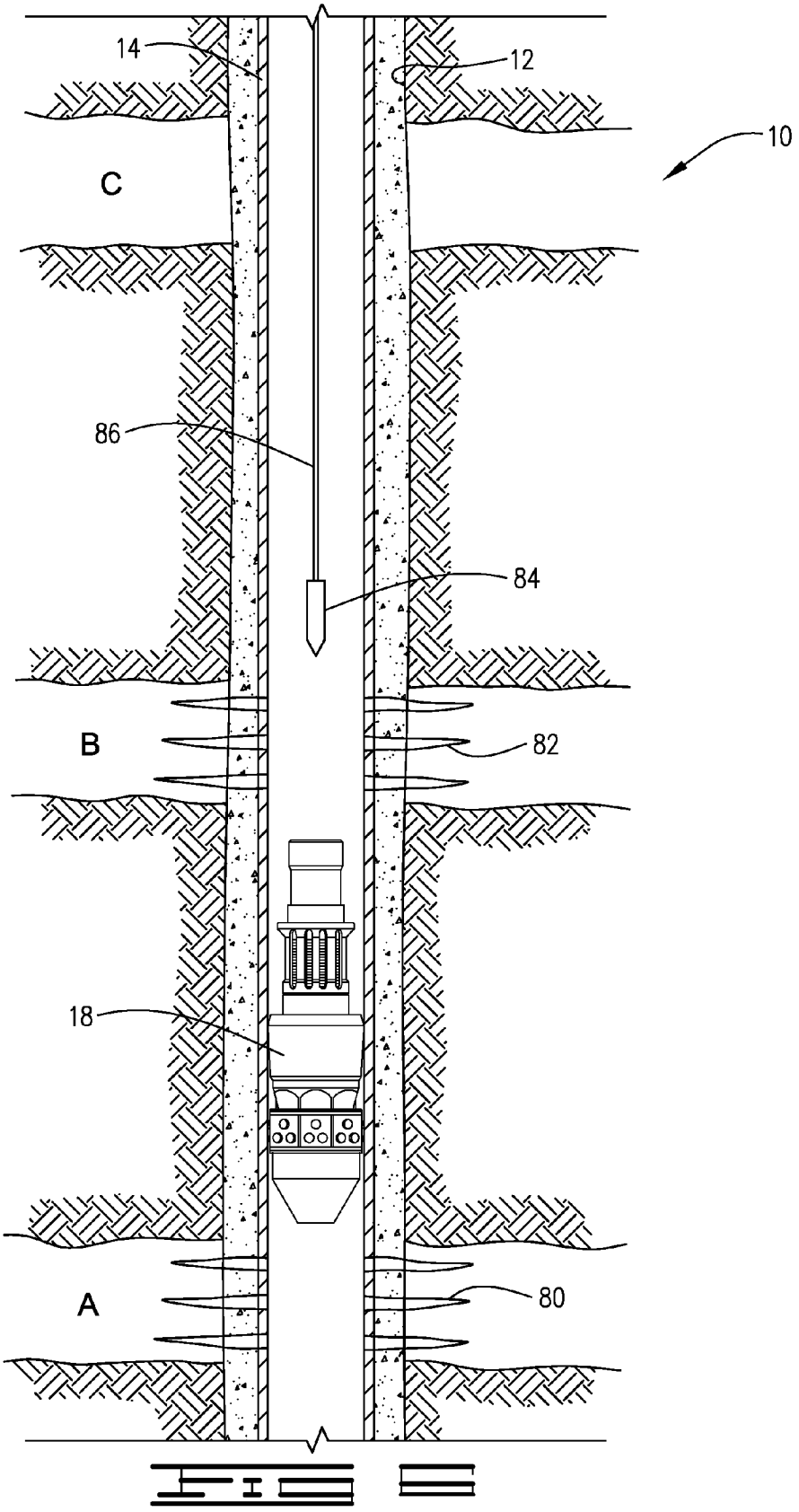
FIG. 6 is a schematic, cross-sectional view of an wellbore with a frangible downhole tool in accordance with one embodiment of the invention. The frangible downhole tool is set between producing zones A and B and an impact tool is shown.

FIG. 6 shows an exemplary method of fragmenting a frangible downhole tool 18 by an impact fragmenter. An impact fragmenter or impact tool 84, which is a sharp hard tool such as a metal cone, is lowered into wellbore 12 by wire line or slick line 86. Impact tool 84 is impacted on downhole tool 18, such as by dropping tool 84 through bore 33 of setting tool connector 32 to impact on the top portion 28 of mandrel 20. Through one or more such impacts, mandrel 20 is shattered and falls away from the rest of downhole tool 18. If needed, subsequent impacts from impact tool 84 (by lifting it through the wire line 86 and dropping it back on downhole tool 18) can be used to remove other components that are made of frangible material.

Figure 7:
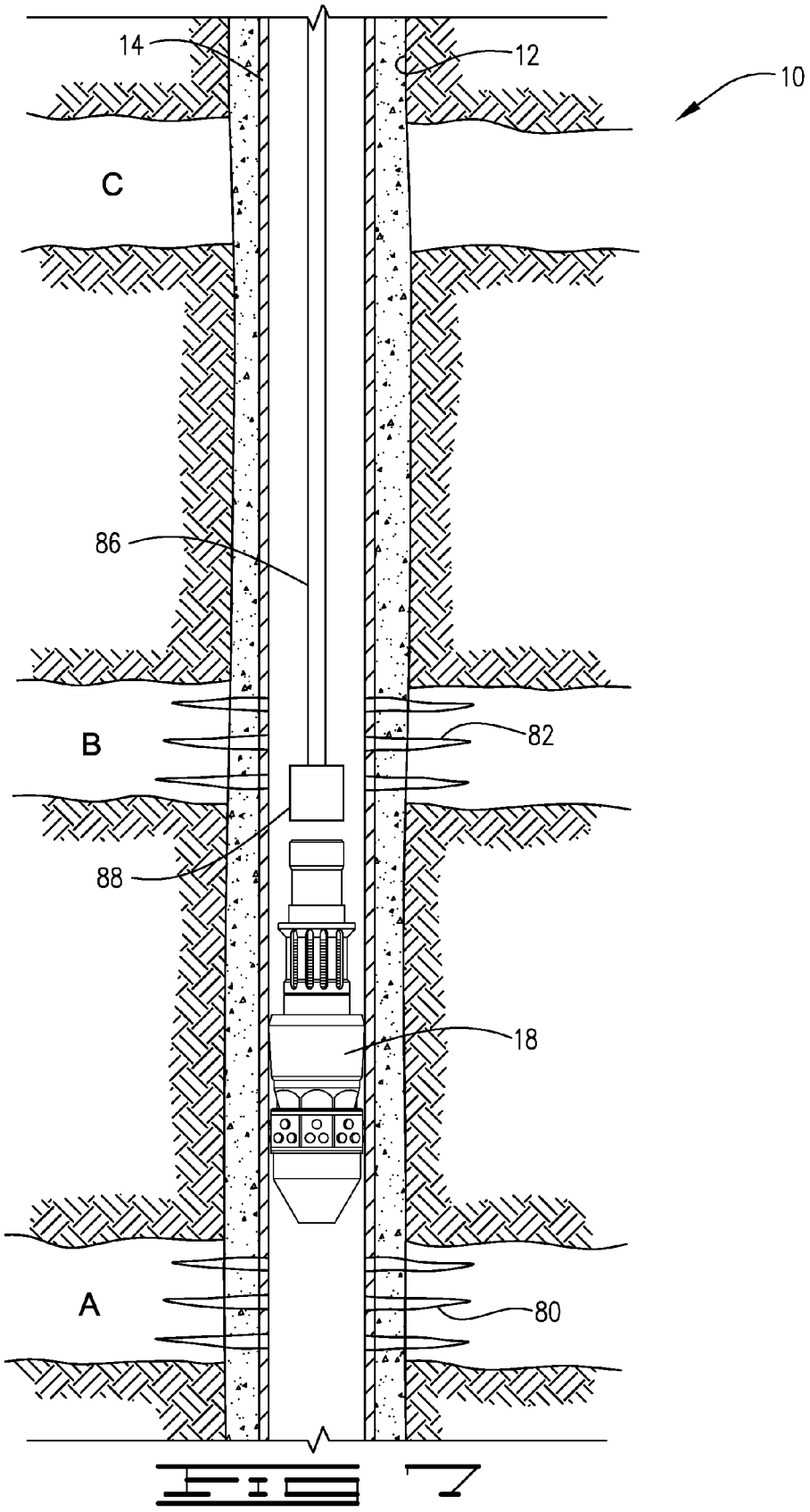
FIG. 7 is a schematic, cross-sectional view of an wellbore with a frangible downhole tool in accordance with one embodiment of the invention. The frangible downhole tool is set between producing zones A and B and a pressure wave fragmenter is shown.

FIG. 7 shows an exemplary method of fragmenting a frangible downhole tool 18 by pressure wave fragmenter 88. A pressure wave fragmenter 88 capable of emitting an acoustical pulse or wave is lowered into wellbore 12 by wire line or slick line 86 to near downhole tool 18. For example, pressure wave fragmenter 88 could be a mud pulse tool such as used in drilling operations for logging while drilling. Additionally, various firing heads utilizing percussion detonators can be used as the pressure wave fragmenter 88, one such firing head is sold under the trademark HalSonics by Halliburton Energy Services, Inc. Pressure wave fragmenter 88 is activated so that it emits a pressure wave causing vibrations in downhole tool 18 which cause the frangible portions to shatter and fall away from the rest of downhole tool 18. Alternatively, each frangible component can incorporate within its structure a device that would resonate with the pressure wave in such a way as to cause a sharp object within the components structure to impact the structure and cause it to shatter.

Additionally, a frangible downhole tool can be fragmented by traditional drill out methods. The use of a drill bit can provide impact and break up of the frangible material. Advantageously, a frangible downhole tool has a significantly shortened drill-out time than traditional downhole tools.

Figure 8:
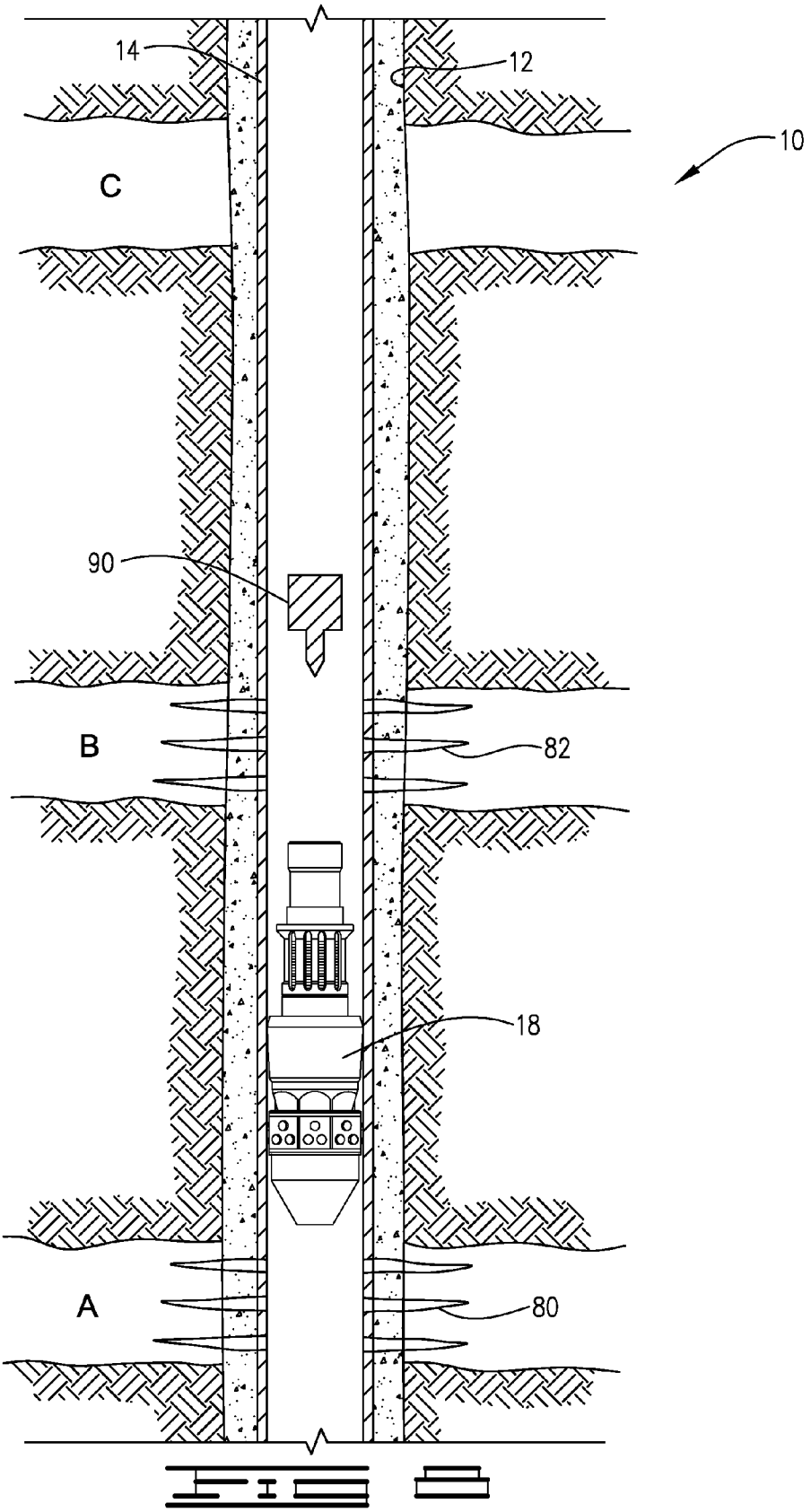
FIG. 8 is a schematic, cross-sectional view of a wellbore with a dissolvable downhole tool in accordance with one embodiment of the invention. The dissolvable downhole tool is set between producing zones A and B and a gravity dart is shown.

FIG. 8 shows an exemplary method of applying a chemical solution to a dissolvable downhole tool 18. The chemical solution may be applied before or after the downhole tool 18 is installed within the wellbore 12. Further, the chemical solution may be applied before, during, or after the fluid recovery operations. For those embodiments where the chemical solution is applied before or during the fluid recovery operations, the dissolvable material, the chemical solution, or both may be customized to ensure that downhole tool 18 dissolves over time while remaining intact during its intended service.

As depicted in FIG. 8, a gravity dart 90 may be used to release the chemical solution 90 onto downhole tool 18. Gravity dart 90 moves by free falling within the wellbore 12. The chemical solution, which can dissolve the dissolvable components of downhole tool 18, is stored within the gravity dart 90, which is frangible. In this embodiment, the gravity dart 90 is moved by fluid pressure within the wellbore 12 and engages the downhole tool 18 with enough force to break the dart 90, thereby releasing the chemical solution onto downhole tool 18 and dissolving the dissolvable components.

As will be readily apparent, there are a number of other ways to dissolve the dissolvable components. For example, a pumpable dart may be used to release the chemical solution onto the downhole tool 18. The pumpable dart engages and seals against the casing within the wellbore. Therefore, fluid must be pumped into the wellbore behind the pumpable dart to force the dart to move within the wellbore and contact downhole tool 18. In another example, an enclosure is provided on the downhole tool for storing the chemical solution. An activation mechanism, such as a slideable valve, for example, may be provided to release the chemical solution from the enclosure onto the downhole tool. This activation mechanism may be timer-controlled or operated mechanically, hydraulically, electrically, or via communication means, such as a wireless signal, for example. This embodiment would be advantageous for fluid recovery operations using more than one downhole tool, since the activation mechanism for each downhole tool could be actuated as desired to release the chemical solution from the enclosure and dissolve each downhole tool at the appropriate time with respect to the fluid recovery operations. In a further example, a wire line or slick line 86 could be used to lower an ultraviolet light source or a nuclear source in the vicinity of the downhole tool. Exposure to one of these sources will dissolve at least some components of the downhole tool, thereby causing the downhole tool to release from the wellbore, and the undissolved components of the downhole tool to fall to the bottom of the wellbore.

If additional well stimulation/fracturing operations will be performed, such as recovering hydrocarbons from zone C, additional downhole tools 18 may be installed within the wellbore 12 to isolate each zone in accordance with the procedure outline above.

Figure 9:
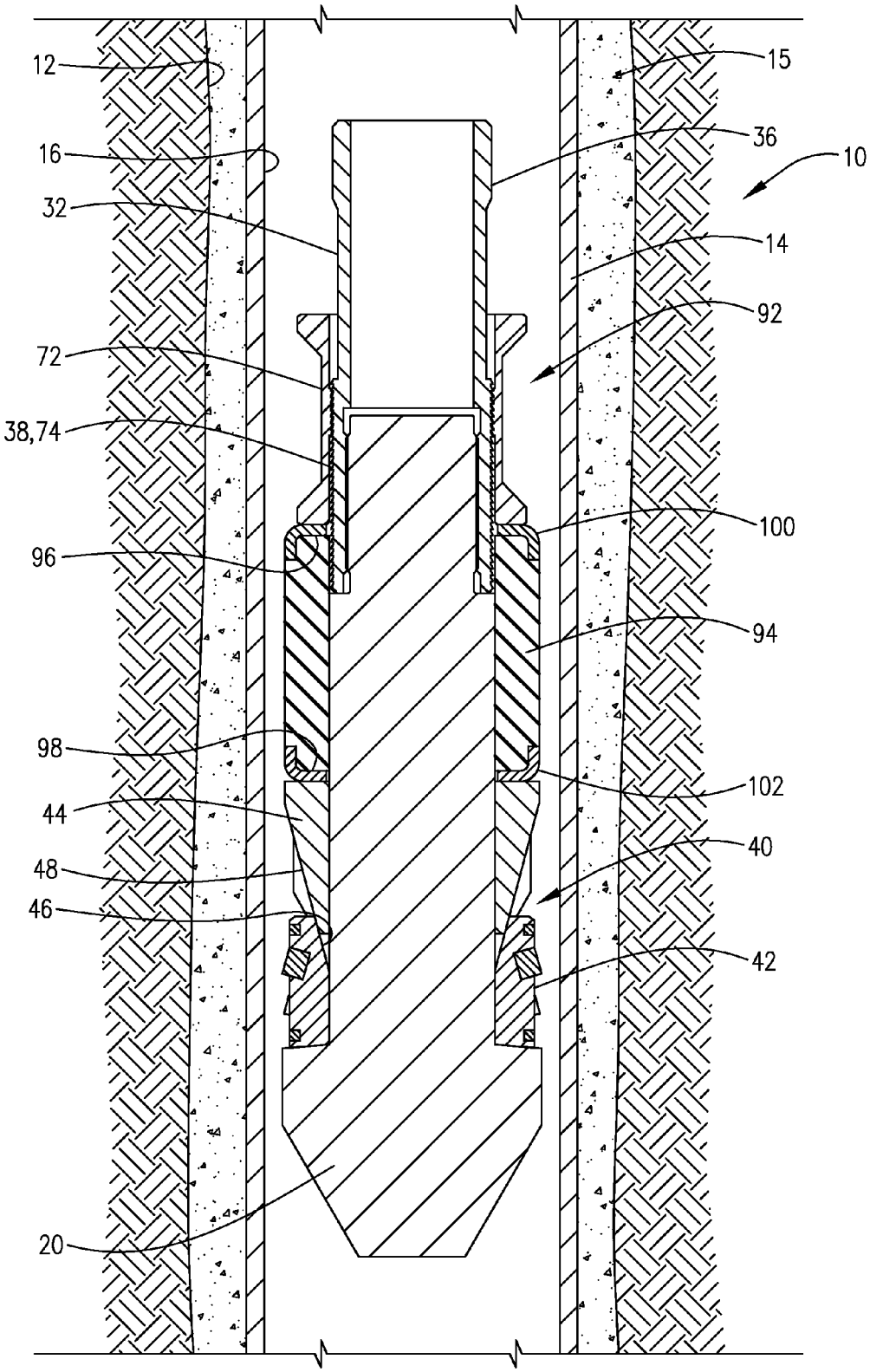
FIG. 9 is a schematic, cross-sectional view of a wellbore in which a downhole tool in accordance with an embodiment of the invention is illustrated. The downhole tool is illustrated in the unset position.

Turning now to FIG. 9, another embodiment of a downhole tool 92 using frangible or dissolvable components is illustrated. Downhole tool 92 is similar to downhole tool 18 but it uses a more traditional sealing element 94 instead of cup-shaped sealing element 60. As such it is not designed to use a low setting pressure but could be used with dissolvable materials and potentially frangible materials depending on the setting pressure and strength of the frangible materials utilized. Common elements to downhole tool 18 and downhole tool 92 have been given the same numbers.

Downhole tool 92 has first extrusion limiter 100 and second extrusion limter 102, which support first end 96 and second end 98, respectively, of sealing element 94 during setting of downhole tool 92. In setting downhole 92, a setting tool (not shown) engages with the setting tool connector 32 at upper end 36. The setting tool applies axial force to ratcheted sleeve 72 causing it to move axially towards extrusion limiter 100 from a first position to a second position and thereby asserting axial force on extrusion limiter 100. The interaction of ratcheting teeth 38 and 74 prevent sleeve 72 from moving axially away from extrusion limiter 100. Thus, even if the setting tool is disengaged, sleeve 72 will remain in the second position and maintain its pressure on extrusion limiter 100.

Extrusion limiter 100 transfers axial force to extrusion limiter 102 through sealing element 94. Extrusion limiter 102 abuts slip assembly 40 and moves axially so that it, in turn, transfers the axial force to slip wedge 44 of slip assembly 40. This causes slip wedge 44 to move axially with first surface 46 and second surface 48 sliding over one another so that slip wedge 44 moves further underneath slip ring 42; that is, between slip ring 42 and mandrel 20. The movement of slip wedge 44 exerts a radially outward force on slip ring 42 so that it grippingly engages the wellbore 12, generally the inner wall 16 of casing 14. As slip ring 42 grippingly engages wellbore 12, the axial force on sealing element 94 causes compression; thus, sealing element 94 expands radially outwardly and causing it to sealingly engage the wellbore 12, generally the inner wall 16 of casing 14. Removal of downhole tool 92 can be by the methods described above for downhole tool 18.

Removing a downhole tool, such as described above, from the wellbore is more cost effective and less time consuming than removing conventional downhole tools, which requires making one or more trips into the wellbore with a mill or drill to gradually grind or cut the tool away. The foregoing descriptions of specific embodiments of a frangible tool and dissolvable tool, and the systems and methods for removing such tools from the wellbore have been presented for purposes of illustration and description and are not intended to be exhaustive or to limit the invention to the precise forms disclosed. Many other modifications and variations are possible. In particular, the type of downhole tool, or the particular components that make up the downhole tool could be varied.

While various embodiments of the invention have been shown and described herein, modifications may be made by one skilled in the art without departing from the spirit and the teachings of the invention. The embodiments described here are exemplary only, and are not intended to be limiting. Many variations, combinations, and modifications of the invention disclosed herein are possible and are within the scope of the invention. Accordingly, the scope of protection is not limited by the description set out above, but is defined by the claims, which follow. The scope includes all equivalents of the subject matter of the claims.

What is claimed is:

1. A downhole apparatus for use in a wellbore, said apparatus comprising:

a central mandrel;

a slip assembly disposed on said mandrel wherein said slip assembly grippingly engages said wellbore when said downhole apparatus is in a set position;

a cup-shaped sealing element disposed on said mandrel, said cup-shaped sealing element having a radially extending portion such that said cup-shaped sealing element forms a first chamber and a second chamber separated by said radially extending portion, and wherein said first chamber and said second chamber are each defined on one side by said mandrel, and wherein said sealing element sealingly engages said wellbore when said downhole apparatus is in said set position;

a ring element disposed on said mandrel and operationally engaging said sealing element and said slip assembly such that, when a setting force is applied to said ring element, said ring element expands radially outward thus transferring said setting force to said sealing element such that said sealing element sealingly engages said wellbore and said ring element axially transfers said setting force to said slip assembly such that said slip assembly grippingly engages said wellbore; and a sleeve disposed on said mandrel, the sleeve transfers said setting force from a setting tool to said ring element when said downhole apparatus is changed from an unset position to said set position, and wherein a retaining ring is housed in said first chamber and said ring element is housed in said second chamber, and wherein said retaining ring abuts said slip assembly such that, when said setting force is applied, said ring element transfers said setting force to said retaining ring through said radially extending portion of said cup-shaped sealing element and said retaining ring transfers said setting force to said slip assembly.

2. The downhole apparatus of claim 1 wherein said sleeve is a ratcheting sleeve such said sleeve is moved axially from a first position to a second position by said setting tool when said downhole apparatus is changed from an unset position to said set position and thereafter stays in said second position.

3. The downhole apparatus of claim 1 wherein said mandrel and said slip assembly are at least partially made of a material selected from the group consisting of frangible materials, dissolvable materials and combinations thereof.

4. The downhole apparatus of claim 3 wherein said mandrel and said slip assembly are at least partially made of glass.

5. The downhole apparatus of claim 3 wherein said mandrel and said slip assembly are at least partially made of a frangible material selected from the group consisting of borosilicate, aluminosilicate, soda lime, sapphire, fused quartz/silica and combinations thereof.

6. A downhole apparatus for use in a wellbore, said apparatus comprising:

a central mandrel comprised of glass that breaks apart under impact or pressure wave;

a cup-shaped sealing element disposed about said mandrel, wherein said cup-shaped sealing element has a radially extending portion such that said cup-shaped sealing element forms a first chamber and a second chamber separated by said radially extending portion, and wherein said first chamber and said second chamber are each defined on one side by said mandrel, and wherein said sealing element sealingly engages said wellbore when said downhole apparatus is in a set position;

a slip assembly disposed on said mandrel wherein said slip assembly grippingly engages said wellbore when said downhole apparatus is in a set position and wherein said slip assembly is at least partially made from glass;

a ring element disposed on said mandrel and operationally engaging said sealing element and said slip assembly such that, when a setting force is applied to said ring element, said ring element expands radially outward thus transferring said setting force to said sealing element such that said sealing element sealingly engages said wellbore and said ring element axially transfers said setting force to said slip assembly such that said slip assembly grippingly engages said wellbore; and a ratcheting sleeve disposed on said mandrel wherein said sleeve is moved axially from a first position to a second position by a setting tool when said downhole apparatus is changed from an unset position to said set position and thereafter stays in said second position and wherein said sleeve transfers said setting force from said setting tool to said ring element when said downhole apparatus is changed from an unset position to said set position, and wherein a retaining ring is housed in said first chamber and said ring element is housed in said second chamber, and wherein said retaining ring abuts said slip assembly such that, when said setting force is applied, said ring element transfers said setting force to said retaining ring through said radially extending portion of said cup-shaped sealing element and said retaining ring transfers said setting force to said slip assembly.

7. A method of performing a downhole operation comprising:

introducing a downhole tool having a mandrel into a wellbore to a predetermined depth; and applying an axial force to a ring element disposed about said mandrel so as to move said downhole tool from an unset position to a set position at said predetermined depth; wherein under said axial force, said ring element moves axially along said mandrel to thus transfer said axial force to a slip assembly disposed about said mandrel such that said slip assembly grippingly engages said wellbore and, under said axial force, said ring element expands radially outward to thus transfer said axial force to a cup-shaped sealing element disposed about said mandrel such that said cup-shaped sealing element sealingly engages said wellbore, and wherein:

said cup-shaped sealing element has a radially extending portion such that said cup shaped element forms a first chamber and a second chamber separated by said radially extending portion;

said first chamber and said second chamber are each defined on one side by said mandrel;

a retaining ring is housed in said first chamber and said ring element is housed in said second chamber; and said retaining ring abuts said slip assembly such that, when said setting force is applied, said ring element transfers said setting force to said retaining ring through said radially extending portion of said cup-shaped sealing element and said retaining ring transfers said setting force to said slip assembly.

8. The method of claim 7, further comprising:

after said downhole tool is moved to said set position, lowering a fragmenter downhole; and fragmenting a first portion of said downhole tool using said fragmenter, wherein said first portion of said downhole tool is composed of frangible material, and wherein said fragmenter is an impact tool designed to shatter said first portion of said downhole tool.

9. The method of claim 7, further comprising:

after said downhole tool is moved to said set position, lowering a fragmenter downhole; and fragmenting a first portion of said downhole tool using said fragmenter, wherein said first portion of said downhole tool is composed of frangible material, and wherein said fragmenter is a pressure wave device designed to produce a pressure wave and thus shatter said first portion of said downhole tool.

10. The method of claim 9 wherein said pressure wave device produces an acoustical pulse.

11. The method of claim 9 wherein said frangible material is glass.

12. The method of claim 7 wherein said downhole tool comprises a frac plug, a bridge plug or a packer.

* * * * *